United States Patent [19]

Sieg et al.

[11] 4,293,401

[45] Oct. 6, 1981

[54] SHALE RETORTING WITH SUPPLEMENTAL COMBUSTION FUEL

[75] Inventors: Robert P. Sieg, Walnut Creek; Byron G. Spars, Mill Valley, both of Calif.

[73] Assignee: Chevron Research Company, San Francisco, Calif.

[21] Appl. No.: 123,149

[22] Filed: Feb. 21, 1980

[51] Int. Cl.[3] ..... C10G 1/00; C10B 49/22

[52] U.S. Cl. ..... 208/11 R; 201/31

[58] Field of Search ..... 208/11 R; 201/32, 31

[56] References Cited

U.S. PATENT DOCUMENTS

| | | | |
|---|---|---|---|
| 2,589,109 | 3/1952 | Martin | 201/23 |
| 3,044,948 | 7/1962 | Eastman | 208/11 R |
| 3,118,746 | 1/1964 | Stratford | 208/11 R |
| 3,384,569 | 5/1968 | Peet | 208/11 R |
| 3,483,116 | 12/1969 | Hoffert | 208/11 R |
| 3,484,364 | 12/1969 | Hemminger | 208/11 R |
| 3,939,057 | 2/1976 | Reed, Jr. | 208/11 R |
| 4,199,432 | 4/1980 | Tamm | 208/11 R |

OTHER PUBLICATIONS

Development of the Lurgi-Ruhrgas Retort for the Distillation of Oil Shale, Oct. 1973.

*Primary Examiner*—T. M. Tufariello

*Attorney, Agent, or Firm*—D. A. Newell; S. R. LaPaglia; R. H. Evans

[57] ABSTRACT

Disclosed is an oil shale retorting process which is suitable for retorting lean oil shale containing less than 0.13 liters of oil per kilogram of shale. The raw shale is preferably retorted in a staged turbulent bed and the retorted hydrocarbonaceous vapors containing entrained shale fines are withdrawn therefrom. The fines are concentrated in a portion of the liquid product and fed to a combustion with the previously retorted shale to provide the heat required for retorting the raw shale.

7 Claims, 1 Drawing Figure

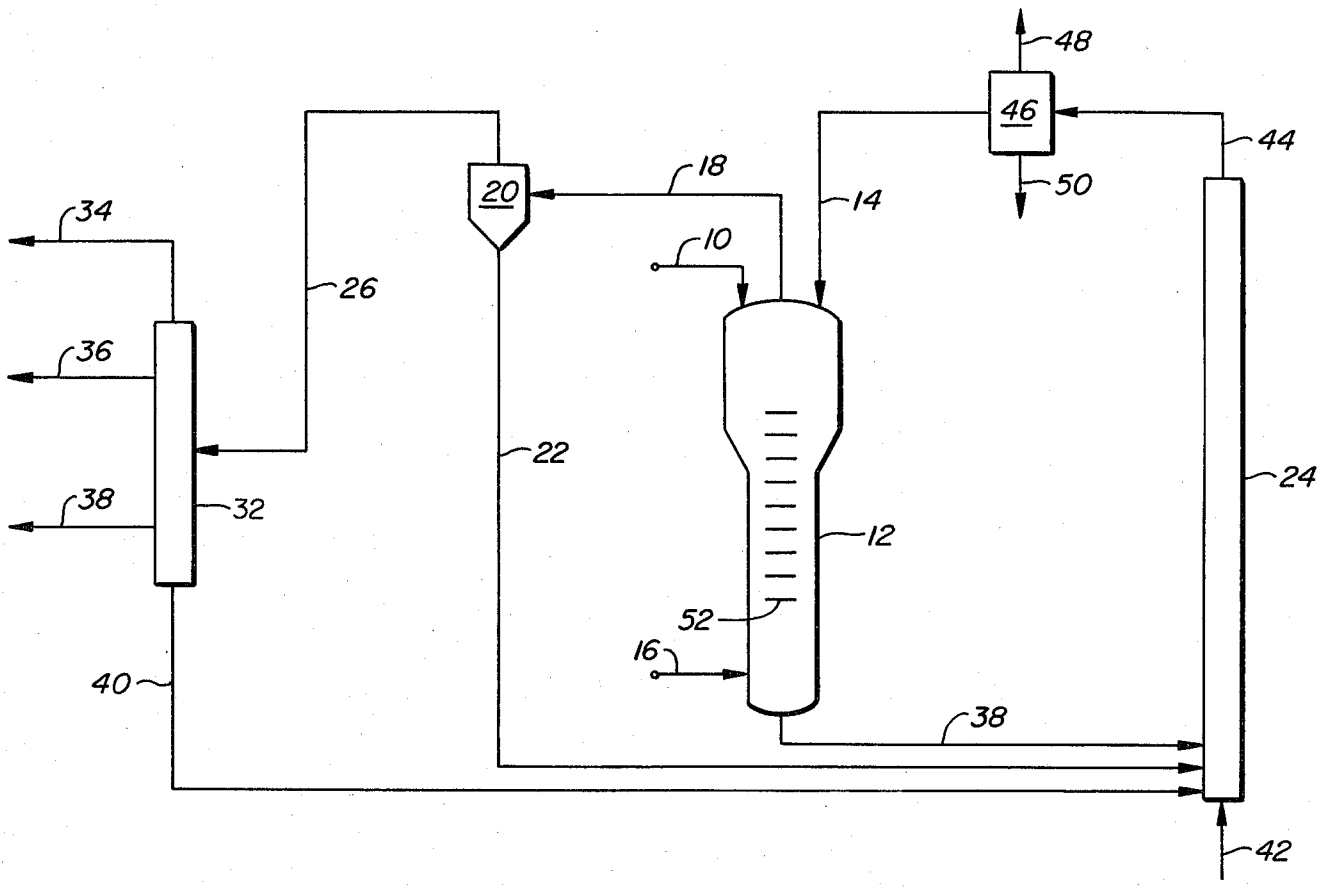
24
44
42
48
46
50
38
14
12
18
10
52
16
22
20
26
32
34
36
38
40

SHALE RETORTING WITH SUPPLEMENTAL COMBUSTION FUEL

BACKGROUND OF THE INVENTION

1. Field of the Invention

The present invention relates to the retorting of oil shale. More specifically, the invention pertains to the retorting of low grade shale wherein at least part of the heat required in the retort is provided through combustion of residual carbonaceous material remaining on previously retorted shale and wherein shale fines in the retorted oil product are removed to facilitate downstream processing.

2. Description of the Prior Art

Vast natural deposits of shale in Colorado, Utah and Wyoming contain appreciable quantities of organic matter which decompose upon pyrolysis to yield oil, hydrocarbon gases and residual carbon. The organic matter or kerogen content of these deposits has been estimated to be equivalent to approximately 500 million cubic meters of oil. As a result of the dwindling supplies of petroleum and natural gas, extensive research efforts have been directed to develop retorting processes which will economically produce shale oil on a commercial basis from these vast resources.

In principle, shale retorting simply comprises heating the raw shale to an elevated temperature and recovering the vapors evolved. The process heat requirements may be supplied either directly or indirectly. Directly heated retorting processes rely upon the combustion of fuel in the presence of the oil shale to provide sufficient heat for retorting. Such processes result in lower product yields due to unavoidable combustion of some of the product and dilution of the product stream with the products of combustion. Indirectly heated retorting processes generally use a separate furnace or equivalent vessel in which a solid or gaseous heat carrier is heated. The hot heat carrier is subsequently mixed with the shale to provide heat, thus resulting in higher yields while avoiding dilution of the retort products with combustion products.

In essentially all above-ground processes for the retorting of shale, the shale is first crushed to reduce the size of the shale to aid in materials handling and to reduce the time for retorting. Unfortunately crushing operations have little or no control over the breadth of the resulting particle size distribution, as this is primarily a function of the rock properties. Normally a considerable quantity of shale fines are produced through the initial crushing step.

As the shale is retorted, even more fines are generated since the shale particles lose strength, beome more friable and less resistant to degradation by attrition during the process.

Many processes (see U.S. Application Ser. No. 889,156 incorporated herein by reference) strip the evolved vapors from the retorted shale as an integral step of product recovery with steam or other gases. Unfortunately, the stripping fluid and evolved vapors also entrain quantities of the fines produced through the initial crushing operation or resulting from attrition in the retort. These fines create problems in downstream processing of the product and must be ultimately removed.

Certain of the more thermally attractive processes use the energy value of the residual carbon on the retorted shale as a source of energy. Typical processes illustrating this approach include U.S. Pat. No. 3,784,462 issued to G. W. Frick, U.S. Pat. No. 4,054,492 issued to R. Rammler et al and U.S. Application Ser. No. 889,156.

In U.S. Pat. No. 3,784,462 retorted shale particles are heated by combustion of its residual carbon to provide a hot heat transfer medium which is countercurrently contacted with raw shale.

In U.S. Pat. No. 4,054,492 spent shale is combusted in a lift pipe and mixed with raw shale in a horizontal distillation vessel.

In U.S. Application Ser. No. 889,156, hot spent shale, heated by combustion in air, and raw shale are introduced into an upper portion of an elongated vessel and pass downwardly therethrough countercurrent to an upwardly flowing stripping gas. A product stream of hydrocarbon vapors, stripping gas and entrained solids are recovered overhead while the retorted solids and spent shale carrier are withdrawn from the bottom of the retort.

With most of the processes the shale fines removal is accomplished by conventional techniques such as batteries of hot filters, cyclone separators, electrostatic precipitators and the like, thus adding to the plant capital cost.

SUMMARY OF THE INVENTION

In accordance with the present invention there is provided in a process for retorting lean oil shale, wherein at least a part of the heat for retorting is supplied by the combustion of residual carbon on the previously retorted shale and wherein the shale oil liquid product contains fines, the improvement comprising:

concentrating said fines in a portion of the shale oil liquid product, and combusting said portion of the liquid product with the previously retorted shale to provide a portion of the process heat requirements.

Concentration of the fines may be accomplished by a number of ways such as distillation, hydrocloning, deasphalting, partial condensation, or the like. The concentration step may be conducted directly after the retort or preferably after removing part of the fines prior to condensation of the retort vapors.

BRIEF DESCRIPTION OF THE DRAWING

The drawing is a schematic flow diagram of one embodiment of apparatus and flow paths suitable for carrying out the process of the present invention.

DETAILED DESCRIPTION OF THE PREFERRED EMBODIMENTS

As used herein, the term "oil shale" refers to fine-grained sedimentary inorganic material which is predominantly clay, carbonates and silicates in conjunction with organic matter composed of carbon, hydrogen, sulfur, oxygen, and nitrogen, called "kerogen".

The term "retorted shale", as used herein, refers to oil shale from which essentially all of the volatizable hydrocarbons have been removed, but which may still contain carbonaceous residue.

The term "spent shale" as used herein refers to retorted shale from which a substantial portion of the carbonaceous residue has been removed, for example by combustion in a combustion zone.

The terms "condensed", "noncondensable", "normally gaseous", or "normally liquid" are relative to the condition of the subject material at a temperature of 25° C. (77° F.) and a pressure of one atmosphere.

Particle size, unless otherwise indicated, is measured with respect to Tyler Standard Sieve sizes.

Referring now to the drawing, raw oil shale particles and hot spent shale particles are introduced through lines 10 and 14, respectively, into an upper portion of a vertically elongated retort 12 and pass downwardly therethrough. A stripping gas, substantially free of molecular oxygen, is introduced, via line 16, to a lower portion of retort 12 and is passed upwardly through the retort, fluidizing a portion of the shale particles. Hydrocarbonaceous materials retorted from the raw oil shale particles, stripping gas, and entrained fines are withdrawn overhead from an upper portion of retort 12 through line 18. A portion of the entrained fines are separated in zone 20 from the hydrocarbonaceous material and stripping gas and said fines pass via line 22 to a lower portion of combustor 24. Alternatively, these entrained fines could be returned to a lower section of retort 12 if desired. Effluent retorted shale particles are removed from a lower portion of retort 12 through line 38 and also pass to the lower portion of said combustor.

The hydrocarbonaceous materials and stripping gas passing from zone 20 through line 26 are introduced as feed to a fines concentration unit 32, which is preferably a distillation column. In column 32 the feed is separated into a gaseous product, distillates and a heavy shale oil liquid fraction containing shale fines which exit the column through lines 34, 36, 38 and 40 respectively.

Air is introduced into a lower portion of combustor 24 through line 42 and provides oxygen to burn the organic residue on effluent retorted shale particles, the fines, and the fines containing heavy liquid fraction, passing via line 40, introduced thereto. The combustion heats the previously retorted shale, which is removed with the flue gas from an upper portion of the combustor through line 44 and passes to separation zone 46. A portion of the spent shale, preferably above 200 mesh, is recycled from separation zone 46 through line 14 to retort 12 to provide process heat. Hot flue gas and the excess spent shale pass from separation zone 46 through lines 48 and 50, respectively.

Referring in detail to the drawing, crushed raw oil shale particles are introduced through line 10, by conventional means, into an upper portion of a retort, generally characterized by reference numeral 12, and passed downwardly therethrough. Spent shale, at an elevated temperature, is also introduced by conventional means through line 14 into the upper portion of said retort and passes downwardly therethrough cocurrently with the raw crushed oil shale. The maximum particle size for the raw shale or heat carrier introduced is maintained at or below 2½ mesh, Tyler Standard Sieve size. Particle sizes in this range are easily produced by conventional means such as cage mills, jaw, or gyratory crushers. The crushing operations may be conducted to produce a maximum particle size, but little or no control is effected over the smaller particle sizes produced. This is particularly true in regard to the crushing of shale which tends to cleave into slab or wedged-shape fragments.

The temperature of the spent shale introduced to the retort via line 14 will normally be in the range of 600° C.–800° C., depending upon the selected operating ratio of heat carrier to shale. The fresh shale may be introduced at ambient temperature or preheated if desired to reduce the heat transfer required between fresh shale and heat carrier. The temperature at the top of the retort should be maintained within the broad range, 450° C. to 540° C., and is preferably maintaned in the range of 480° C. to 510° C.

The weight ratio of spent shale heat carrier to raw oil shale may be varied from approximately 1.5:1 to 8:1 with a preferred weight ratio in the range of 2.0:1 to 3:1. It has been observed that some loss in product yield occurs at the higher weight ratios of spent shale to fresh shale and it is believed that the cause for such loss is due to increased adsorption of the retorted hydrocarbonaceous vapor by the larger quantities of spent shale. Furthermore, attrition of the spent shale, which is a natural consequence of retorting and combustion of the shale, occurs to such an extent that high recycle ratios cannot be achieved with spent shale alone. If it is desired to operate at the higher weight ratios of heat carrier to fresh shale, an auxiliary attrition resistant material, such as sand, may be substituted as part or all of the heat carrier.

The mass flow rate of fresh oil shale through the retort should be maintained between 4,900 kg/hr-m$^2$ and 29,300 kg/hr-m$^2$, and preferably between 9,800 kg/hr-m$^2$ and 19,600 kg/hr-m$^2$. Thus, in accordance with the broader recycle heat carrier weight ratios stated above, the total solids mass rate will range from approximately 12,200 kg/hr-m$^2$ to 261,000 kg/hr-m$^2$.

A stripping gas, preferably steam, is introduced, via line 16, into a lower portion of the retort and passes upwardly through the vessel in countercurrent flow to the downwardly moving shale. The flow rate of the stripping gas should be maintained so as to produce a superficial gas velocity at the bottom of the vessel in the range of approximately 30 cm per second to 150 cm per second, with a preferred superficial velocity in the range of 30 cm per second to 60 cm per second. Stripping gas may be comprised of steam, recycle product gas, hydrogen or any inert gas. It is particularly important, however, that the stripping gas selected be essentially free of molecular oxygen to prevent product combustion within the retort.

The stripping gas will fluidize those particles of the raw oil shale and spent shale heat carrier having a minimum fluidization velocity less than the velocity of the stripping gas. Those particles having a fluidization velocity greater than the gas velocity will pass downwardly through the retort, generally at a faster rate than the fluidized particles. Limiting the maximum bubble size and the vertical backmixing of the downwardly moving shale and heat carrier produces stable, substantially plug flow conditions through the retort volume. True plug flow, wherein there is little or no vertical backmixing of solids, allows much higher conversion levels of kerogen to vaporized hydrocarbonaceous material than can be obtained, for example, in a fluidized bed retort with gross top to bottom mixing. In conventional fluidized beds or in stirred tank type reactors, the product stream removed approximates the average conditions in the conventional reactor zone. Thus, in such processes partially retorted material is necessarily removed with the product stream, resulting in either costly separation and recycle of unreacted materials, reduced product yield, or a larger reactor volume giving much longer average particle residence times. Maintaining substantially plug flow conditions by substantially limiting top to bottom mixing of solids, however, allows one to operate the process on a continuous basis with a much greater control of the residence time of individual particles. The use of means for limiting substantial vertical backmixing of solids also permits a substantial reduction in size of the retort zone required for a given mass throughput, since the chances for removing partially retorted solids with the retorted solids are reduced. The means for limiting backmixing and limiting the maximum bubble size indicated by reference numeral 52, may be generally described as barriers, baffles, dispersers or flow redistributors, and may, for example, include spaced horizontal perforated plates, bars, screens, packing, or other suitable internals.

Gross vertical backmixing should be avoided, but highly localized mixing is desirable for purposes of heat transfer in that it increases the degree of contacting between the solids and the solids and gases. The degree of backmixing is, of course, dependent on many factors, but is primarily dependent upon the particular internals or packing disposed within the retort.

A product effluent stream comprised of hydrocarbonaceous material admixed with the stripping gas is removed from the upper portion of the retort by conventional means through line 18 and passes to separation zone 20. The product effluent stream will contain entrained fines, and it is preferred that at least a portion of said fines be separated from the remainder of the stream at this juncture. This separation may be effected by any suitable or conventional means, such as cyclones, pebble beds and/or electrostatic precipitators. Preferably the fines which are separated from the product effluent stream pass via line 22 to the combustor, generally characterized by reference numeral 24. Product effluent, containing the remaining fines, passes from the separation zone via line 26 to distillation column 32.

The distillation column 32 preferably comprises a multi-tray fractionation tower which separates the retort product into the desired boiling range materials, for example, gas and water vapor 34, naphtha 36, kerosene 38 and a heavy bottoms fraction 40. The heavy bottoms fraction removed via line 40 will normally boil above about 465° C. to above about 555° C. and substantially all of the remaining fines will be concentrated in said fraction. The heavy fraction will normally also contain the more refractory components of the whole shale oil thus facilitating downstream treatment of the lighter products, in addition to removing the fines which would poison and/or plug dowmstream catalytic units. Alternatively, the retort vapors could be partially condensed with the fines present in the heavy oil produced.

As the raw oil shale is pyrolyzed in the retort, the kerogen is decomposed and driven off in the vapor state, leaving an organic residue on the mineral structure. The amount of cabonaceous matter remaining is dependent upon various factors, but at the temperatures required for commercial retorting, the primary factor is the grade or richness of the raw oil shale. When Green River kerogen is pyrolyzed at 500° C., it yields approximately 62 weight percent oil, 13 weight percent gas, 8 weight percent water, and 17 weight percent carbon residue. Thus, the lower grade shales will have proportionately less organic residue. For oil shales yielding less than about 0.13 liters per kilogram, the quantity of organic residue is insufficient to supply the total heat required for retorting the raw shale when directly mixed in the preferred ratios of 2:1–3:1 of spent to raw shale after combustion of the carbon residue.

The retorted shale along with the spent shale serving as heat carrier is removed from the lower portion of the retort via line 38 by conventional means at the retort temperature. From line 38 the retorted shale and spent shale are fed to a lower portion of combustor 24.

The heavy bottoms fraction 40 taken from column 32 is also pumped or fed by conventional means to the bottom of the combustor to provide the additional energy required to heat the spent shale. While combustor 24 may be of conventional design, it is preferred that it be a dilute phase lift combustor. Air is injected into the lower portion of the combustor via line 42 and the organic residue on the shale and the heavy oil is burned. The combustion heats the retorted shale to a temperature in the range of 600° C. to 800° C. and the hot shale and flue gas are removed from the upper portion of the combustor via line 44 and passed to separation zone 46. A portion of the hot spent shale is recycled via line 14 to provide heat for the retort. Preferably said recycled shale is classified to remove substantially all of the minus 200 mesh shale fines prior to introduction to the retort in order to minimize entrained fines carryover in the effluent product vapor. Hot flue gases are removed from the separation zone via line 48 and excess spent shale is passed from the zone via line 50. The clean flue gas and/or spent solids passing from zone 46 via lines 48 and 50 may be used to provide heat for steam generation or for heating process streams.

While the fines concentration step has been particularly discussed with respect to a distillation column, other conventional concentration equipment would also be suitable, such as hydroclones, filters, partial condensers and deasphalters.

With such equipment, the fines are concentrated in a portion of the oil, although not necessarily a high boiling fraction, and the portion is fed to the combustor as described above.

Although the present invention has been particularly described with reference to a specific type of retorting process, it should not be construed as being limited to same. Practitioners of the art will readily recognize the application of the invention to other retorting processes which encounter problems with fines contamination of the product and which rely upon burning residual carbon from the retorted shale to provide the retorting heat requirements.

What is claimed is:

1. In a process for retorting lean oil shale wherein the process involves the steps of mixing raw oil shale with hot spent shale in the upper portion of a vertically elongated retorting vessel characterized by internal means to limit substantial vertical backmixing of solids passing downward therethrough; passing the mixture of raw shale and spent shale downward through the retorting vessel as a continuous moving bed of material; retorting the raw shale in the presence of a generally countercurrent flow of a stripping gas entering the bottom of the retorting vessel to carry away shale oil vapor and fines present in the retorting vessel; and burning the residual carbonaceous material adhering to the retorted shale in a liftpipe to heat the spent shale, the improvement comprising concentrating said fines in a portion of the shale oil liquid product; and combusting said portion of the shale oil liquid product with the residual carbonaceous material adhering to the retorted shale.

2. A process as recited in claim 1 wherein said lean oil shale contains less than 0.13 liters of oil per kilogram of oil shale.

3. A process as recited in claim 1 wherein said concentrating step is accomplished by distilling the oil shale product to produce a heavy fraction of the oil shale product which contains a substantial portion of the total fines in the shale oil liquid product.

4. A process as recited in claim 1 wherein said concentrating step is accomplished by hydrocloning the shale oil liquid product to produce a portion of the shale oil liquid product which contains a substantial portion of the total fines in the shale oil liquid product.

5. A process as recited in claim 1 wherein said concentrating step is accomplished by solvent deasphalting the shale oil liquid product to produce a portion of the shale oil liquid product which contains a substantial portion of the total fines in the shale oil liquid product.

6. A process as recited in claim 1 wherein said concentrating step is accomplished by filtering the shale oil liquid product to produce a portion of the shale oil liquid product which contains a substantial portion of the total fines in the shale oil liquid product.

7. A process as recited in claim 1 wherein said concentrating step is accomplished by partially condensing the shale oil liquid product to produce a portion of the shale oil liquid product which contains a substantial portion of the total fines in the shale oil liquid product.

* * * * *